United States Patent [19]

Hellman, Sr.

[11] Patent Number: 4,995,549

[45] **Date of Patent: * Feb. 26, 1991**

[54] METHOD AND APPARATUS FOR FORMING AND WELDING THIN-WALL TUBING

[76] Inventor: Robert R. Hellman, Sr., 35 Hawley Rd., Oxford, Conn. 06483

[ * ] Notice: The portion of the term of this patent subsequent to Mar. 6, 2007 has been disclaimed.

[21] Appl. No.: 488,257

[22] Filed: Mar. 5, 1990

Related U.S. Application Data

[63] Continuation-in-part of Ser. No. 278,819, Dec. 1, 1988, Pat. No. 4,905,885.

[51] Int. Cl.[5] ..... B23K 5/06; B23K 9/025

[52] U.S. Cl. ..... 228/147; 228/15.7

[58] Field of Search ..... 228/144, 146, 147, 150, 228/151, 173.7, 17.5, 5.7; 219/59.1, 60 R, 61, 61.1, 61.11, 61.7, 64

[56] References Cited

U.S. PATENT DOCUMENTS 4,905,885 3/1990 Hellman, Sr. ..... 228/17.5

*Primary Examiner*—Sam Heinrich

*Attorney, Agent, or Firm*—John H. Crozier

[57] ABSTRACT

A method and apparatus for forming thin-wall tubing in a funnel die or with a series of sets of forming rollers. The tubing is then welded by a method and apparatus which includes simultaneous guiding of the both the inner and outer peripheries of the tubing during the welding operation by a mandrel and a sleeve, respectively, so that lack of rigidity of the tubing is not a limitation. The edges of the tubing are not clamped, but are allowed to "float" during welding in one embodiment, a water-cooled heat sink is used to remove the heat of welding. The resulting tubing is highly uniform. A wide range of tubing materials can be welded and thin-wall tubing of nearly any desired length or wall thickness can be produced.

17 Claims, 7 Drawing Sheets

METHOD AND APPARATUS FOR FORMING AND WELDING THIN-WALL TUBING

This is a continuation-in-part of copending application Ser. No. 07/278,819, filed Dec. 1, 1988, now U.S. Pat. No. 4,905,885, issued Mar. 6, 1990.

BACKGROUND OF THE INVENTION

1. Field of the Invention.

The present invention relates to thin-wall tubing generally and, more particularly, to a novel method and apparatus for forming and welding the seam of such tubing, which method and apparatus economically produce a product having superior quality and in wider ranges of materials, diameters, and thicknesses than heretofore available.

2. Background Art.

Thin-wall tubing is useful in a number of applications and is of particular value in the manufacture of metal bellows. Such bellows have utility in such varied applications as pressure and thermal sensors, seals, expansion joints and chambers, and vibration dampeners. The convolutions of the bellows are typically formed by mechanical means from welded thin-wall tubing, after the tubing is formed. Such bellows are manufactured, for example, by Westport Development Manufacturing Company, Inc., Orange, Conn. It will be understood that, in the manufacture of such bellows, it is of critical importance that the weld on the tubing used be strong and that the diameter of the tubing be uniform.

Known methods and apparatus for forming welded thin-wall tubing have a number of substantial limitations, one of which is the relatively high cost of the apparatus. In one type of apparatus, the basic tubing shape is formed from flat strip and the seam is welded by moving the tubing under a fixed welding torch. This type of apparatus relies on the formed tube itself for support, there being no internal support, and, therefore, there is a practical limit to the thinness of the tube. For example, the minimum wall thickness for a 4-inch diameter tube is on the order of 0.020 inch.

In another type of apparatus, the edges of the formed tube are fixedly clamped to a mandrel surface by means of a plurality of fingers and the welding torch is moved along the seam. This type of apparatus has the advantage of being able to weld a variety of shapes, in addition to round tubing, but has as one disadvantage the practical limitation of a relatively short maximum length. Also, the apparatus requires careful adjustment of a "springy" piece of sheet metal to butt the edges perfectly. Too high a clamping pressure will cause the mandrel to bend and too low a clamping pressure will cause the resulting tube to be tapered because it laps over during the welding and cooling process. If supports are added under the mandrel, there is a risk of marking or wrinkling the tube. Typically, the lower dimensional limits on tubes produced with this type of apparatus are 0.0055 wall thickness and 1¼-inch OD.

Neither type of apparatus has the ability to readily handle difficult to weld materials such as Monel.

Accordingly, it is a principal object of the present invention to provide a method and apparatus for forming and welding thin-wall tubing which will produce such tubing of wider ranges of wall thicknesses, diameters, and materials than available with conventional methods and apparatus.

Another object of the invention is to provide such method and apparatus which produces such tubing having a uniform diameter and no tapering.

An additional object of the invention is to provide such method and apparatus which produces such tubing of any desired length.

A further object of the invention is to provide such method and apparatus which is relatively economical and easy to use.

Other objects of the invention, as well as particular features and advantages thereof, will, in part, be obvious and will, in part, be apparent from the following description and the accompanying drawing figures.

SUMMARY OF THE INVENTION

The present invention accomplishes the above objects, among others, by providing a method and apparatus for forming thin-wall tubing in a funnel die or with a series of sets of forming rollers. The tubing is then welded by a method which includes simultaneous guiding of the both the inner and outer peripheries of the tubing during the welding operation by a mandrel and a sleeve, respectively, so that lack of rigidity of the tubing is not a limitation. The edges of the tubing are not clamped, but are allowed to "float" during welding. In one embodiment, a water-cooled heat sink is used to remove the heat of welding. The resulting tubing is highly uniform. A wide range of tubing materials can be welded and thin-wall tubing of nearly any desired length or wall thickness can be produced.

DETAILED DESCRIPTION OF THE PREFERRED EMBODIMENTS

Figure 1:
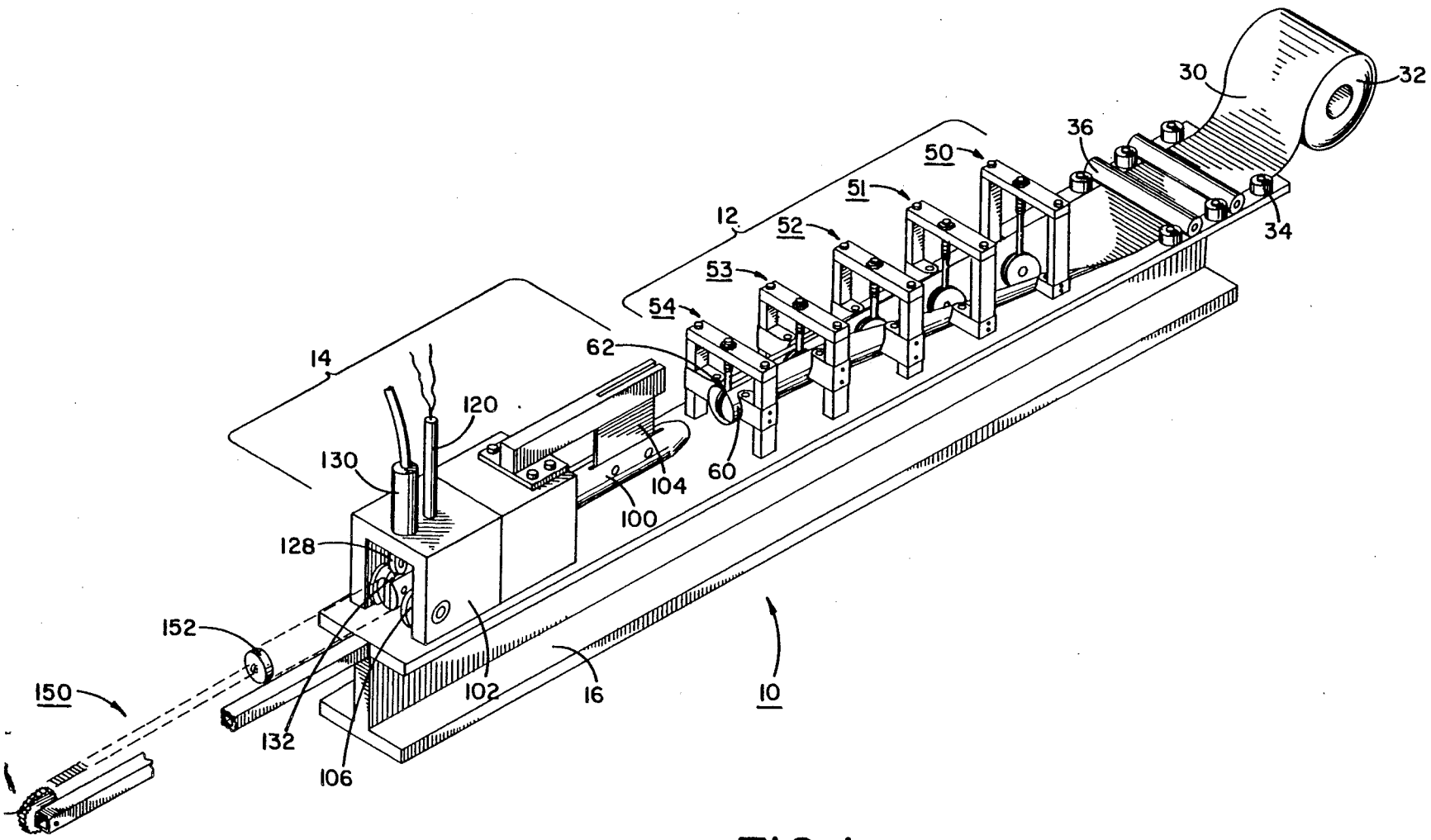
FIG. 1 is a perspective view of one embodiment of a tube forming/welding apparatus according to the present invention.
Figure 2A:
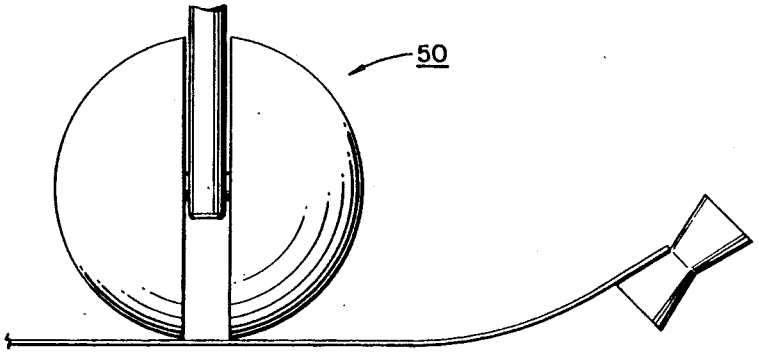
FIGS. 2(*a*) through 2(*e*) are partial front elevation views showing the tube forming apparatus of FIG. 1.
Figure 2B:
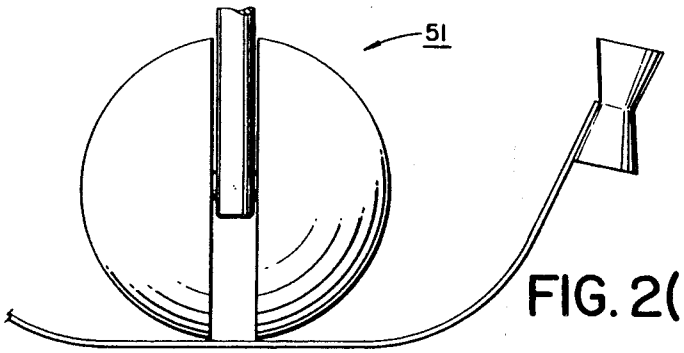
Figure 2C:
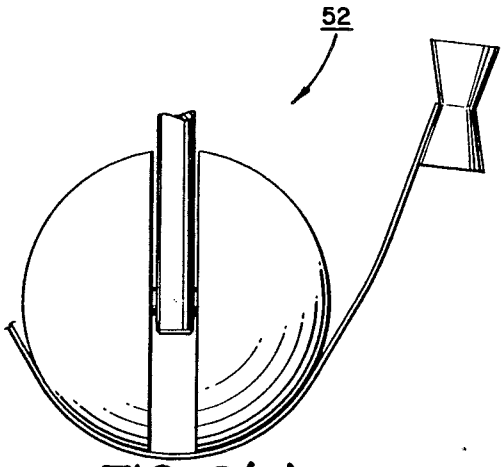
Figure 2D:
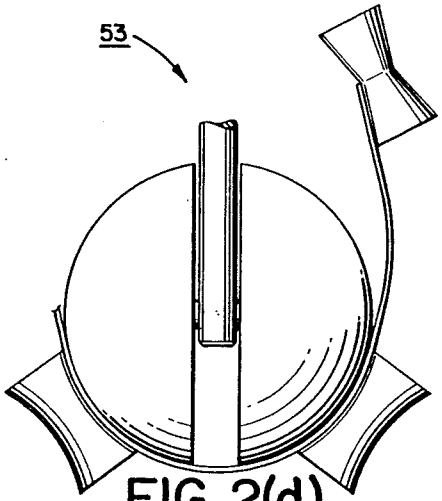
Figure 2E:
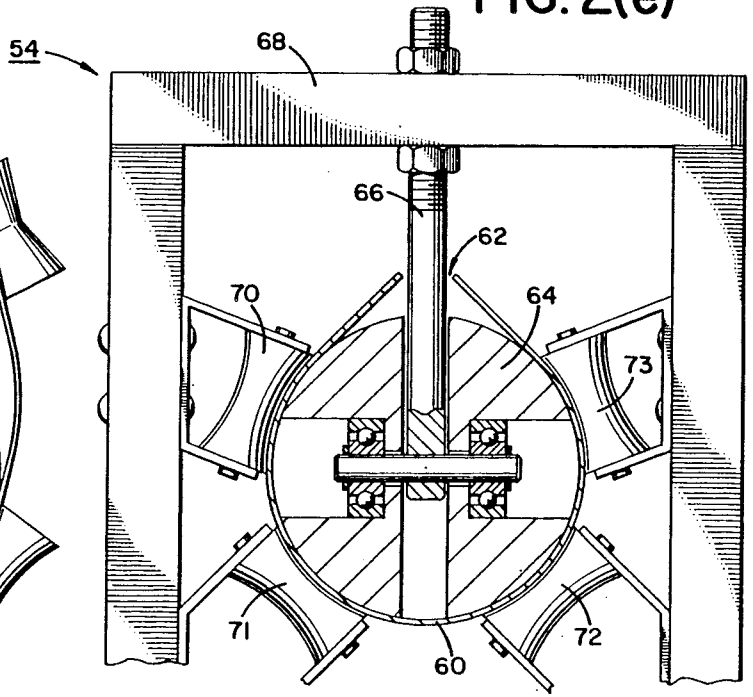
Figures 3, 4, 5:
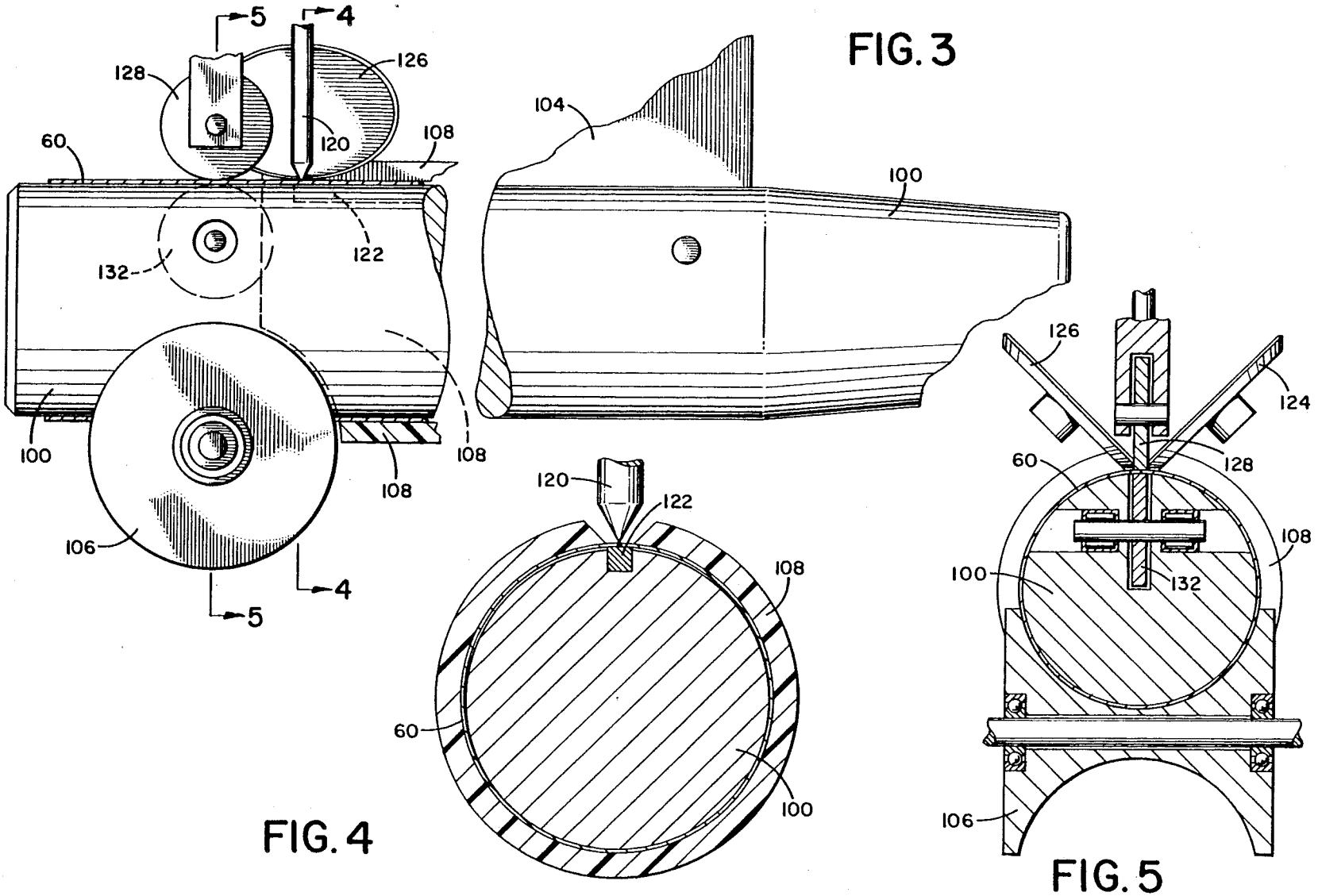
FIG. 3 is a fragmentary side elevation view of the tube welding apparatus of FIG. 1.
FIGS. 4 and 5 are sectional views of FIG. 3.

Referring now to the drawing, in which like or similar elements are given identical reference numerals throughout the various figures, FIG. 1 is a perspective view of a tube forming/welding apparatus, generally indicated by the reference numeral 10, which includes a tube forming section 12 and a tube welding section 14, both sections being mounted on a common base 16.

Tube forming section 12 is supplied with a continuous strip of flat stock 30 from a supply roll 32. A series of edge guide rollers, as at 34, and top guide rollers, as at 36, guide flat stock 30 into tube forming section 12. In tube forming station 12, flat stock 30 passes serially through tube forming stations 50, 51, 52, 53, and 54, in which the flat stock is gradually bent into a circular shape, and exits tube forming station 54 as tube 60 having a longitudinal slot 62.

The function of the elements of each of tube forming stations 50, 51, 52, 53, and 54 may be also seen on FIGS. 2(*a*) through 2(*e*) of which FIGS. 2(*a*) through 2(*d*) are fragmentary front elevation views of tube forming stations 50 through 53, respectively, and FIG. 2(*e*) is a front elevation view, partially in cross section, of tube forming station 54, which is shown in more detail for illustrative purposes, the other tube forming stations being similarly constructed.

Tube forming station 54 includes an internal ball die 64 rotatably attached to a support shaft 66 which is fixedly mounted from a support frame 68 which is fixedly mounted on base 16 (FIG. 1). Forming rollers 70, 71, 72, and 73, rotatably mounted to support frame 68, rotatingly urge tube 60 against internal ball die 64 to give the tube its formed shape as it exits tube forming section 12 (FIG. 1).

From tube forming section 12, tube 60 enters tube welding section 14 where it is slidingly supported internally by a mandrel 100 which extends the length of a welding housing 102 and which is fixedly supported at the tube entry end of the welding housing by a pylon 104 and at the tube exit end of the welding housing by a roller support 106 which is journaled for rotation within the welding housing. The thickness of pylon 104 is sized so as to fit within slot 62 of tube 60.

Referring also to FIGS. 3 through 6, as tube 60 enters welding housing 102 the outer periphery of the tube is slidingly engaged by a sleeve 108, which sleeve has a slight taper from its tube entry end to its tube exit end so as to narrow the width of slot 62 as tube 60 passes through the annulus defined by mandrel 100 and the sleeve. Near the tube exit end of sleeve 108 is a welder 120 disposed so as to seal slot 62 as tube 60 passes beneath the welder. Disposed in the upper surface of mandrel 100 beneath welder 120 is a heat sink 122 which slidingly engages tube 60 and disposed on either side of the welder are roller heat sinks 124 and 126 which rollingly engage the tube. It can be seen (FIG. 3) that sleeve 108 extends beyond welder 120 to assure that the outer periphery of tube 60 is supported while the seam is being welded. It can also be seen (FIG. 5) that tube 60 passes between mandrel 100 and roller support 106 as it leaves welding housing 102.

Figure 6:
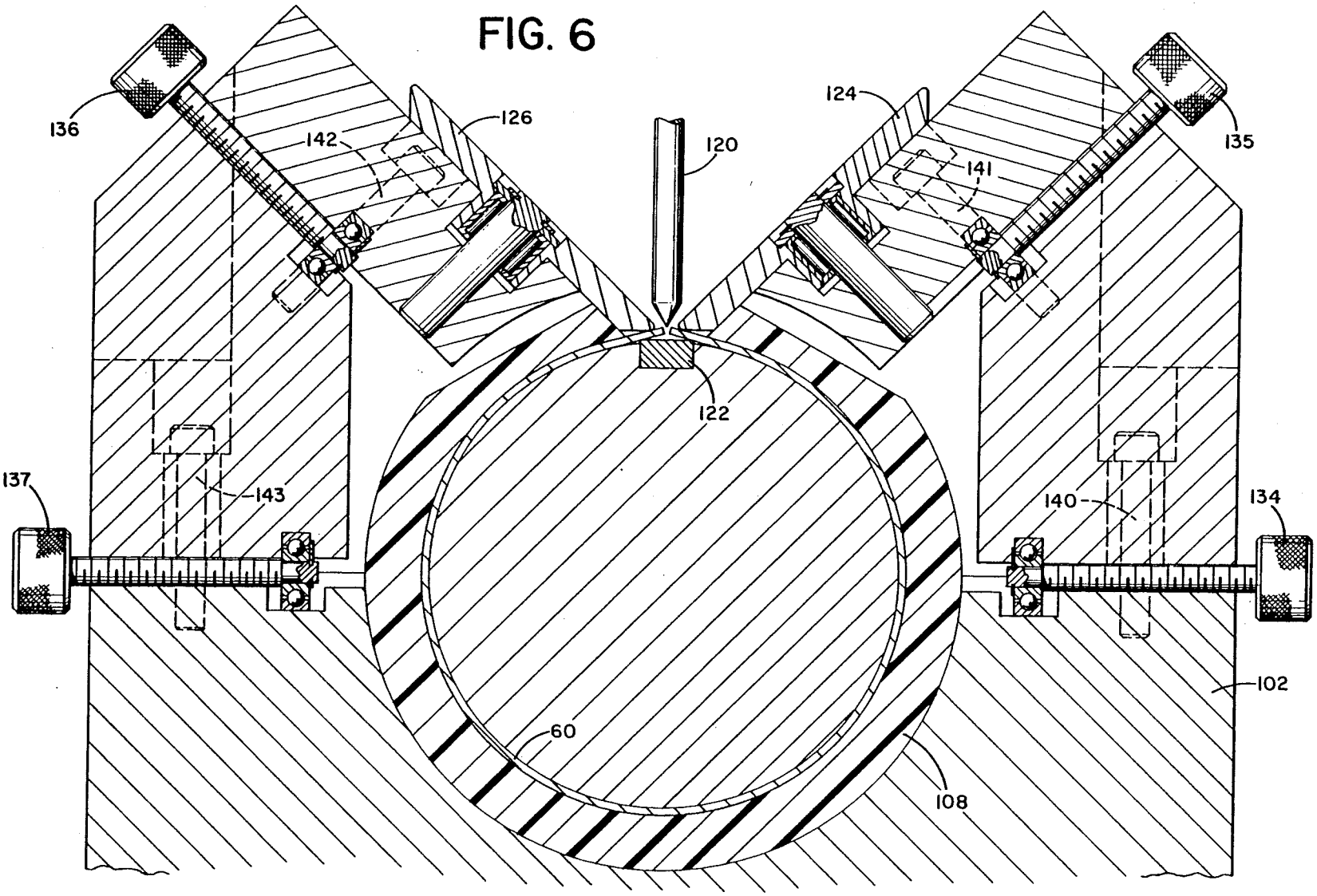
FIG. 6 is an end elevation view, partially in cross section, of the welding apparatus of FIG. 1.

FIG. 6 illustrates the preferred spacial relationships (not to correct relative scale) of welder 120, heat sink 122, and roller heat sinks 124 and 126 and also illustrates the means by which the positions of the roller heat sinks may be adjusted.

Heat sink 122 is fixedly mounted in mandrel 100 so that the heat sink extends slightly above the outer periphery of the mandrel, on the order of about a few thousandths of an inch. Roller heat sinks 124 and 126 are adjusted so that tube 62 is not forced completely against heat sink 122, but rather so that the tube engages the heat sink only at the corners thereof so that the edges of slot 62 angularly approach each other. The gap defined between the edges of roller heat sinks 124 and 126 is preferably in the range of about 0.040 to about 0.060 inch. As tube 60 is welded, the welded portion drops slightly so that the tube assumes a more circular shape.

The positions of roller heat sinks 124 and 126 to achieve the desired gap between the roller heat sinks and the desired position of tube 60 may be adjusted by means of adjustment screws 134, 135, 136, and 137 and set screws 140, 141, 142, and 143.

Following welding, tube 60 passes under a hydraulically controlled bead reduction and smoothing roller 128 the pressure of which roller is controlled by a hydraulic cylinder 130 fixedly mounted on welding housing 102 (FIG. 1). A backing roller 132 is journaled in mandrel 100 to oppose the force of smoothing roller 128 and the axis of roller support 106 is aligned with the axes of the smoothing and backing rollers to transmit that force to housing 102. Smoothing roller 128 is preferably disposed no more than 0.6–0.75 inches from welder 120, so that the smoothing operation takes place while the weld bead is still hot. It has been found that the pressure required for the smoothing operation when the weld bead is hot is about 1400 PSI, while about 13,000 PSI is required if the weld bead is cold.

The weld bead when formed is preferably slightly thicker than the tube wall, on the order of about 0.001 inch. After passing between smoothing and backing rollers 128 and 132, respectively, the thickness of the tube in the area of the weld is essentially the nominal thickness of the wall of tube 60.

A transport mechanism, generally indicated by the reference numeral 150 (FIG. 1), attached to a plug 152 in the end of tube 60 provides the force to feed flat sheet 30 into and through tube forming section 12 and tube 60 through welding section 14. Transport mechanism may be dimensioned so that any desired length of tube may be produced.

Tube forming section 12 is generally limited to thicker metal stock, say, about 0.020 inch thickness with a 4-inch diameter tube and about 0.006–0.008 inch thickness with a ¼-inch diameter tube.

Figure 7:
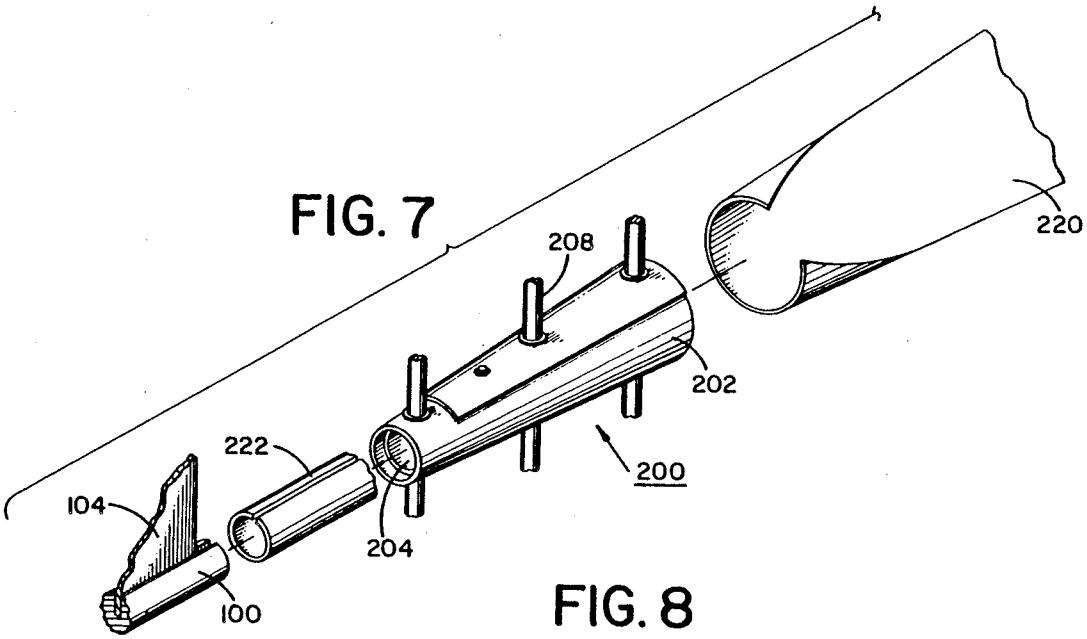
FIG. 7 is a an exploded perspective view of an alternative embodiment of a tube forming apparatus according to the present invention.
Figure 8:
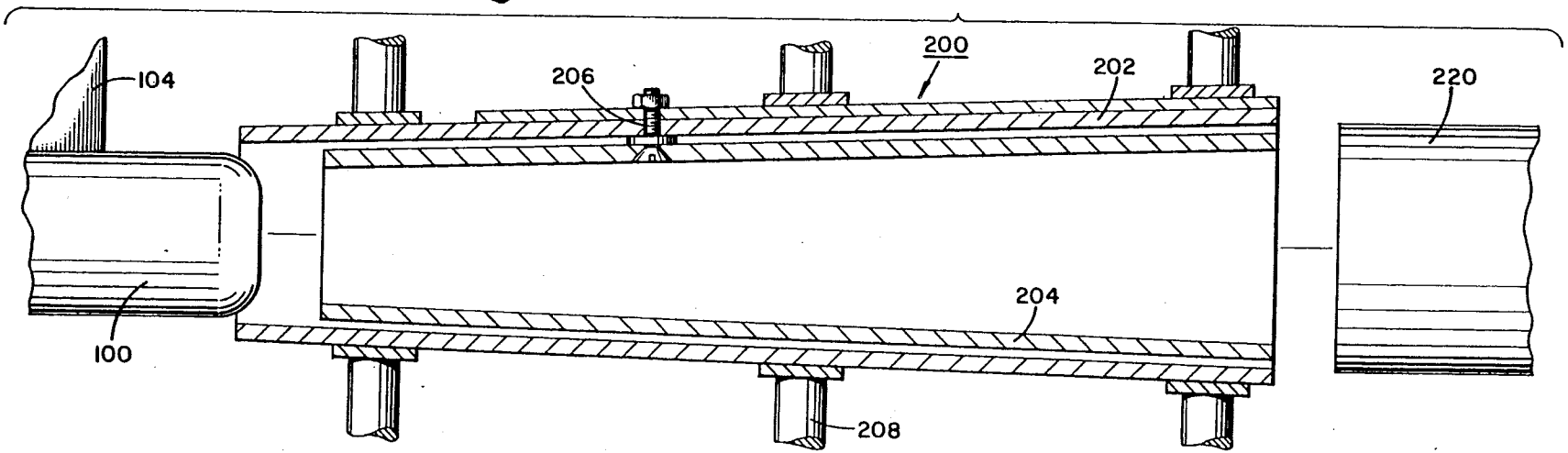
FIG. 8 is a side elevation view, partially in cross section, of the tube forming apparatus of FIG. 7.

An alternative type of tube forming section, one that is satisfactory when using thinner metal stock, down to nearly the thickness of foil is illustrated on FIGS. 7 and 8, where it is generally indicated by the reference number 200. Tube forming section 200 includes an outer die 202 in the form of a truncated hollow cone and an inner die 204 in the form of a truncated cone, coaxially disposed, radially spaced apart by about one to two metal thicknesses, fixedly attached together by fastening means 206, and supported as at 208. A plurality of supports 208 are provided to maintain the dimensional integrity of tube forming section 200. Supports 208 would be fixedly tied together (not shown).

In use, flat sheet stock 220 is manually preformed to match the annulus formed by outer and inner cone dies 202 and 204, respectively, at the large end of tube forming section 200 and then urged therethrough. Upon exiting tube forming section 200, formed tube 222 slides over mandrel 100 of welding section 12, which mandrel extends a short distance into outer cone die 202. While tube may be formed using only outer cone die 202, it has been found that the use of the additional inner cone die 204 is preferable.

It will be understood that if tube forming section 200 is employed, it would be disposed on base 16 in place of tube forming section 12.

Figure 9:
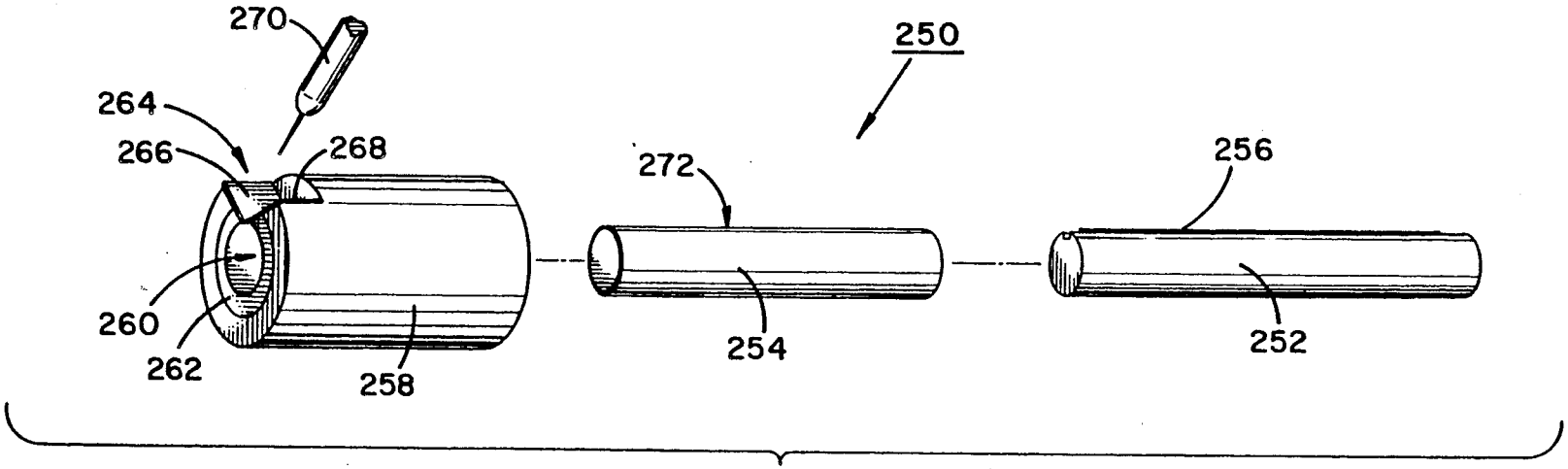
FIG. 9 is an exploded perspective view of an alternative embodiment of a tube welding apparatus according to the present invention.

FIG. 9 is an exploded perspective view of an alternative embodiment of a welding section according to the present invention, generally indicated by the reference numeral 250. Welding section 250 includes a mandrel 252 the OD of which is the ID of the tube 254 to be welded. Mandrel 252 has mounted in the upper surface and substantially along the length thereof a heat sink 256 which has the same function as heat sink 122 in welding section 14 described above. A hollow cylindrical shuttle 258 is provided having a circular interior passageway 260 the diameter of which is equal to the OD of tube 254. Shuttle 258 has the same function as sleeve 108 in welding section 14 described above and preferably has fixed therein a sleeve 262 formed from a material of relatively high lubricity defining the passageway.

Defined at one end of shuttle 258 is an opening 264 on the sides of which are fixedly mounted flat heat sinks 266 and 268 spaced apart the same as, and having the same function as, roller heat sinks 124 and 126 in welding section 14 described above. A welder 270 is positioned to weld the seam 272 in tube 254.

In use, tube 254 is formed, manually or otherwise, around mandrel 252, with the seam 272 of tube 254 located over heat sink 256. Mandrel 258 is then placed over tube 254 on mandrel 252 and moved along it while welder 270 welds seam 272, with heat sinks 264 and 266 urging the areas of the tube around the seam into partial contact with heat sink 256. Mandrel 258 may be moved by any conventional means and an engine lathe may be adapted for use with this embodiment of the invention.

Preferred dimensions of tube forming section 200 are functions of "D", the outer diameter of formed tube 222, and are approximately as follows:

ID of large end of outer cone die 202$=1\frac{1}{2}$D to $1\frac{3}{4}$D.

Axial distance between small ends of inner and outer cone dies 204 and 202$=\frac{1}{4}$D to $\frac{1}{2}$D.

Axial length of outer cone die$=9/10$D.

With either of the welding apparati described above, tubing can be produced having an OD of as small as about 0.3 inch. Wall thickness may be as small as about 0.002 with any practical diameter of tube. The only limitation on the length of the tubing is the ability to handle long lengths of the welded tubing.

It has been found that, in welding shorter lengths of tubing, say, up to about four to five feet in length, that the heat of welding is satisfactorily removed by convection to the ambient air. However, once longer lengths of tubing are being welded, convection cooling has been found to be inadequate and it is necessary to provide water cooling to remove the heat of welding.

Figure 10:
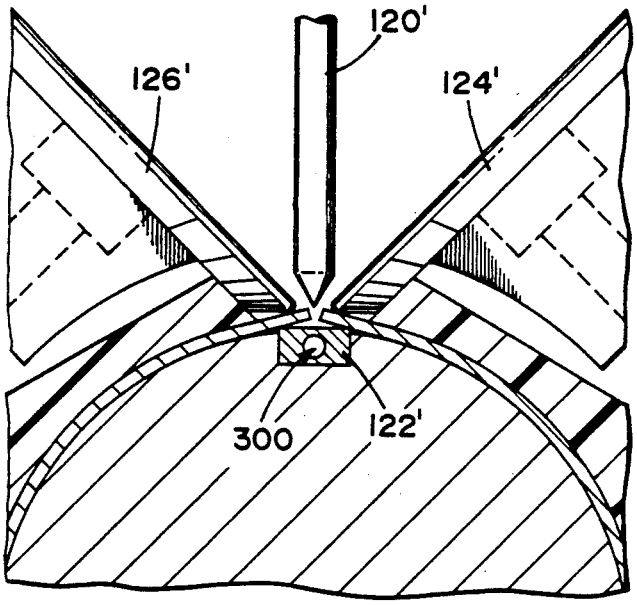
FIG. 10 is a fragmentary end elevation view, partially in cross section, of a welding apparatus similar to that of FIG. 1, but with a water-cooled heat sink therein.
Figure 11:
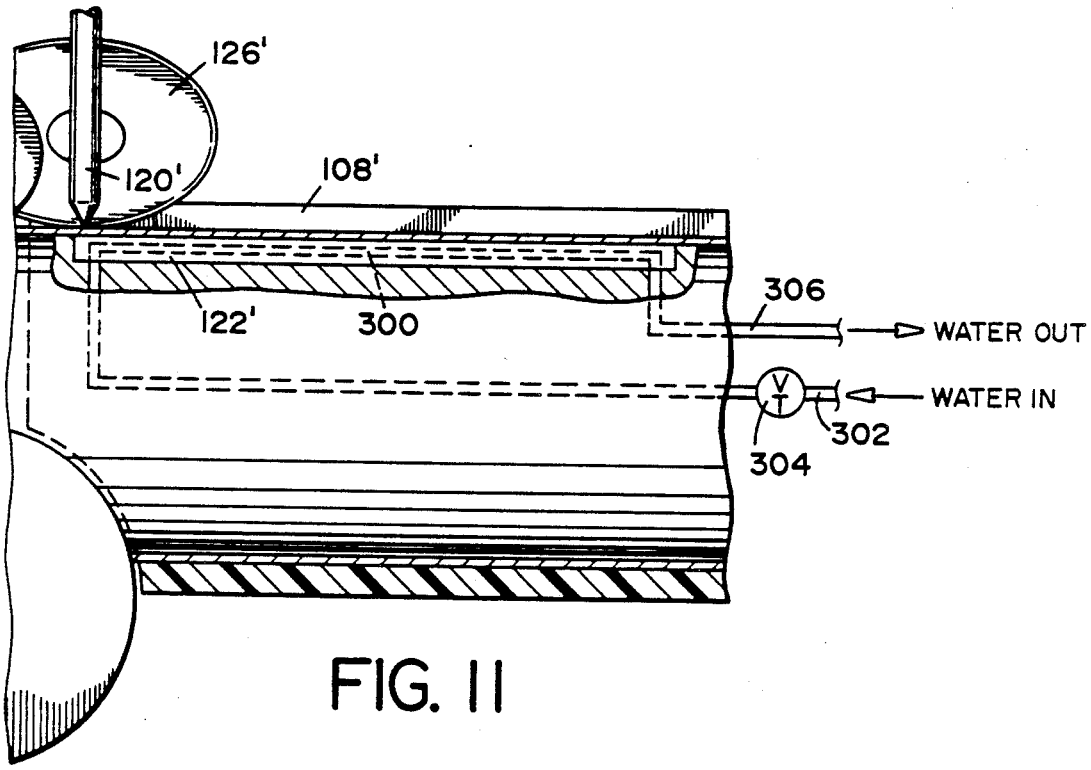
FIG. 11 is a fragmentary side elevation view, partially in cross section of the embodiment of FIG. 10.

FIGS. 10 and 11 illustrate the application of water cooling to the embodiment of the present invention described with reference to FIGS. 1 and 3–6. Here, a heat sink 122' is furnished with an internal water tube 300. Water is supplied to tube 300 through supply line 302 through a valve 304 and exits tube 300 through outlet line 306. It has been found that, when welding the thicknesses of stock in the daimeters discussed herein, a length of heat sink 122' about six inches long cooled with about $\frac{1}{2}$ to 1 gallon per hour of water provides sufficient cooling.

Figure 12:
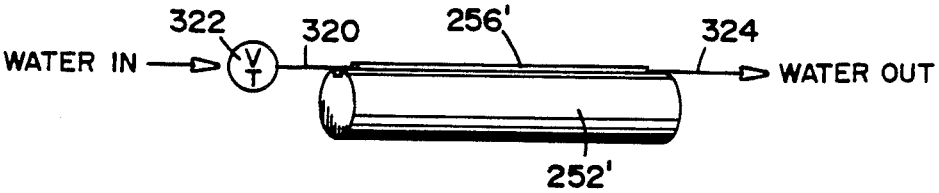
FIG. 12 is a side elevation view of a mandrel for a welding apparatus similar to that of FIG. 9, but with a water-cooled heat sink therein.

FIG. 12 illustrates the application of water cooling to the embodiment of the present invention described with reference to FIG. 9. Here, water is supplied to a heat sink 256' through supply line 320, controlled by valve 322, and exits the heat sink through outlet line 324, as described above with reference to FIGS. 10 and 11.

Elements of the apparatus which slidingly contact metal tube or sheet are preferably formed from, or covered with, an ultra-high molecular weight polyethylene polymer. Heat sinks 122, 256, 266, and 268 and roller heat sinks 124 and 126 are preferably formed from copper. Smoothing and backing rollers 128 and 132 are preferably formed from an alumina ceramic material. Other elements of the invention may be formed from any suitable conventional materials known in the art. Welder 120 may be a tungsten inert gas welder or the equivalent.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An apparatus for welding the longitudinal seam of a tube formed from a flat sheet, comprising:

(a) first support means dimensioned to engage substantially the entire inner periphery of said tube;

(b) second support means, concentric with said first support means, dimensioned to engage substantially the entire outer periphery of said tube, thereby to movably hold said tube in the annulus formed between said first and second support means, at least at the point of welding of said tube;

(c) an opening defined in said second support means adjacent said seam into which opening the edges of said seam protrude in closely spaced apart relationship;

(d) welding means in fixed position relative to said second support means and in welding contact with said seam and adapted for relative movement with said seam, thereby to fill the interstice between the edges of said seam to join said edges; and (e) water cooled first heat sink means fixedly disposed in said first support means adjacent said seam, and in continuous contact therewith, so as to remove heat from the area of said tube surrounding said seam as said seam is welded.

2. An apparatus, as defined in claim 1, further comprising:

(f) second heat sink means, fixedly axially disposed with respect to said second support means and disposed close to said welding means, to urge the area of said tube surrounding said seam into at least partial contact with said first heat sink means.

3. An apparatus, as defined in claim 1, further comprising:

(g) bead smoothing means, fixedly disposed adjacent said welding means, to smooth the weld bead formed by said welding means while said weld bead is hot.

4. An apparatus, as defined in claim 2, wherein said second heat sink means is fixedly mounted in said second support means.

5. An apparatus, as defined in claim 3, wherein said second heat sink means is rotatably mounted with respect to said second support means.

6. An apparatus, as defined in claim 1, wherein said tube is draawn through said annulus as said tube is welded.

7. An apparatus, as defined in claim 1, where said second support means moves along said tube as said tube is welded.

8. An apparatus for welding the longitudinal seam of a tube formed from a flat sheet, comprising:

(a) a base member;

(b) a housing;

(c) a mandrel fixedly disposed within said housing and dimensioned to slidingly engage substantially the entire inner periphery of said tube;

(d) a sleeve, fixedly disposed within said housing and concentric with said first support means, dimensioned to the entire outer periphery of said tube, thereby to slideably hold said tube in the annulus formed between said mandrel and said sleeve, at least at the point of welding of said tube;

(e) an opening defined in said sleeve adjacent said seam into which opening the edges of said seam protrude in closely spaced apart relationship;

(f) welding means fixedly disposed in said housing and positioned to fill the interstice between the edges of said seam to join said edges as said tube is drawn through said annulus; and (g) a water cooled heat sink fixedly disposed in said mandrel, extending slightly above the outer periphery thereof, and adjacent said seam so as to remove heat from the area of said tube surrounding said seam as said seam is welded.

9. An apparatus, as defined in claim 8, further comprising:

(h) roller heat sinks, fixedly axially disposed with respect to said sleeve and disposed close to said welding means, to urge the area of said tube surrounding said seam into contact with only the edges of said heat sink.

10. An apparatus, as defined in claim 8, further comprising:

a bead smoothing roller, fixedly disposed adjacent said welding means, to smooth the weld bead formed by said welding means while said weld bead is hot.

11. A method for welding the longitudinal seam of a tube formed from a flat sheet, comprising:

(a) providing first support means dimensioned to engage substantially the entire inner periphery of said tube;

(b) providing second support means, concentric with said first support means, dimensioned to engage substantially the entire outer periphery of said tube, thereby to movably hold said tube in the annulus formed between said first and second support means, at least at the point of welding of said tube;

(c) providing an opening defined in said second support means adjacent said seam into which opening the edges of said seam protrude in closely spaced apart relationship;

(d) providing welding means in fixed position relative to said second support means and in welding contact with said seam; and (e) providing relative motion between said tube and said welding means whereby said welding means fills the interstice between the edges of said seam to join said edges; and (f) providing water cooled first heat sink means fixedly disposed in said first support means adjacent said seam, and in continuous contact therewith, so as to remove heat from the area of said tube surrounding said seam as said seam is welded.

12. A method, as defined in claim 11, further comprising:

(g) providing second heat sink means, fixedly axially disposed with respect to said second support means and disposed close to said welding means, to urge the area of said tube surrounding said seam into at least partial contact with said first heat sink means.

13. A method, as defined in claim 11, further comprising:

(h) providing bead smoothing means, fixedly disposed adjacent said welding means, to smooth the weld bead formed by said welding means while said weld bead is hot.

14. A method, as defined in claim 12, wherein said second heat sink means is fixedly mounted in said second support means.

15. A method, as defined in claim 12, wherein said second heat sink means is rotatably mounted with respect to said second support means.

16. A method, as defined in claim 11, wherein said tube is drawn through said annulus as said tube is welded.

17. A method, as defined in claim 11, wherein said second support means moves along said tube as said tube is welded.

* * * * *

UNITED STATES PATENT AND TRADEMARK OFFICE

CERTIFICATE OF CORRECTION

PATENT NO. : 4,995,549

DATED : February 26, 1991

INVENTOR(S) : Robert R. Hellman, Sr.

It is certified that error appears in the above-identified patent and that said Letters Patent is hereby corrected as shown below:

In the Abstract, line 9 should read as follows:

--are allowed to "float" during welding. In one embodi---,

Signed and Sealed this

Second Day of July, 1991

*Attest:*

HARRY F. MANBECK, JR.

*Attesting Officer*

*Commissioner of Patents and Trademarks*